United States Patent [19]

Kilches et al.

[11] 4,436,290

[45] Mar. 13, 1984

[54] PLASMA MELTING FURNACE ARRANGEMENT

[75] Inventors: Helmut D. Kilches, Asten; Walter Lugscheider, Linz; Ernst Riegler, Enns; Ernst Zajicek, Ottensheim, all of Austria

[73] Assignee: Voest-Alpine Aktiengesellschaft, Linz, Austria

[21] Appl. No.: 412,202

[22] Filed: Aug. 27, 1982

[30] Foreign Application Priority Data

Sep. 15, 1981 [AT] Austria ..... 3980/81

[51] Int. Cl.[3] ..... C21B 7/22

[52] U.S. Cl. ..... 266/158; 266/144; 373/9

[58] Field of Search ..... 266/158, 159, 144; 75/12; 373/8, 9, 18–25

[56] References Cited

U.S. PATENT DOCUMENTS

| | | | |
|---|---|---|---|
| 2,908,737 | 10/1957 | De Dominieis | 266/158 |
| 3,021,376 | 2/1962 | Vedder et al. | 373/9 |
| 3,164,658 | 1/1965 | Yagi | 373/9 |
| 3,422,206 | 1/1969 | Baker et al. | 373/24 |
| 3,533,611 | 10/1970 | Boyer et al. | 266/158 |

FOREIGN PATENT DOCUMENTS

| | | |
|---|---|---|
| 1205232 | 11/1965 | Fed. Rep. of Germany . |
| 2213588 | 3/1972 | Fed. Rep. of Germany . |
| 2553180 | 6/1977 | Fed. Rep. of Germany . |
| 1244051 | 12/1958 | France . |

*Primary Examiner*—L. Dewayne Rutledge
*Assistant Examiner*—S. Kastler
*Attorney, Agent, or Firm*—Brumbaugh, Graves, Donohue & Raymond

[57] ABSTRACT

A plasma melting furnace includes a cover and a melt container. Through its side wall plasma burners arranged so as to be inclined towards the furnace axis are guided. A main flue gas conduit equipped with a draft regulating damper is connected to the cover and a separate discharge means for flue gases from other furnace openings is additionally provided. In order to provide an efficient discharge of flue gases and reaction gases forming as well as dusts and fumes without straining the furnace hall and the environment, and to maintain a protective gas atmosphere in the furnace interior safely during all the necessary working cycles, the separate discharge means is designed as a downwardly open channel. The channel is peripherally attached to the outer side of the container in the region of the upper rim of the melt container.

4 Claims, 5 Drawing Figures

PLASMA MELTING FURNACE ARRANGEMENT

BACKGROUND OF THE INVENTION

The invention relates to a plasma melting furnace comprising a cover and a melt container through the side wall of which plasma burners, arranged so as to be inclined towards the furnace axis are guided. A main flue gas conduit equipped with a draft regulating damper is connected to the cover, and a separate discharge means for flue gases from other furnace openings also are provided.

In a plasma melting furnace an electric discharge is maintained between the plasma burner(s) constituting the cathode(s) and a bottom electrode or melt as anode. The direct current generates what is called a plasma jet, flowing in an electrically conducting channel of ionized gas introduced via the plasma burners. Preferably, nitrogen is used as the gas for ignition, and a noble gas, such as argon, or mixtures of these gases, are used for the melting procedure. Thus, in the interior of the plasma furnace a protective gas atmosphere is created at the same time, which is to be maintained during the melting procedure with as few admixtures as possible. This is particularly required when melting steel qualities with low nitrogen contents.

When melting contaminated scrap, e.g., oil-containing scrap, a heavy smoke gas development takes place every time, the smoke gases usually being discharged or evacuated via a smoke gas socket in the cover. During evacuation the protective gas also is drawn off and, due to the resulting depression, ambient air and thus nitrogen, oxygen and steam will penetrate into the furnace interior through furnace openings, such as the furnace door and the casting spout. This results in contaminations of the melt, which, after casting, are present as inclusions, such as oxides and nitrides, or as dissolved substances, in the cast piece, thus causing a reduced quality of the same.

From U.S. Pat. No. 3,533,611 a ventilation system for electric arc furnaces is known, by means of which gases and fumes are to be removed and desired atmospheric conditions in the furnace are to be created.

Such an electric arc furnace comprises two separated gas-evacuation conduits for the flue gases, each conduit being provided with a draft regulating damper. Furthermore, a selective switch is provided according to U.S. Pat. No. 3,533,611, which opens and closes the draft regulating dampers via valves alternately during the cycles of melting on the one hand and of refining and slagging on the other hand. The electrodes are led through the furnace arch and the maintenance of a protective gas atmosphere in the furnace interior is not provided. The ventilation system according to U.S. Pat. No. 3,533,611, and in particular the evacuation of the fumes rising from the casting spout and the furnace door, is thus made feasible in a very imperfect manner.

SUMMARY OF THE INVENTION

The invention has as its object to provide a plasma melting furnace—in particular a plasma primary melting furnace—in which the flue gases and reaction gases forming, as well as dusts and fumes, are efficiently discharged without straining the furnace hall and the environment, and with which the protective gas atmosphere in the furnace interior can be safely maintained during all the necessary working cycles—for instance even during possible post-charging or slag-tapping.

The set object is achieved with a plasma melting furnace of the initially defined kind in that the separate discharge means is designed as a downwardly open channel, which, in the region of the upper rim of the melt container, is peripherally attached to the outer side of the container.

By means of this channel, the evacuation of fumes, dust and flue gases is possible in each cycle of the furnace operation independently of the position of the draft regulating damper in the flue gas conduit leading away from the opening in the furnace cover.

Suitably, the channel comprises hood-like enlargements above the furnace door and the casting spout in order to control safely the emergence of flue gases out of these comparatively large furnace openings, even in large amounts.

Preferably, the channel is connected with the flue gas conduit leading away from the cover via a connection conduit in the evacuation direction behind the draft regulating damper. In this manner, only one down-draft ventilator is required, the total flue gases are combined in one conduit and can be purified and dedusted prior to entering the open air, or can be adjusted to a gas separation for recovering protective gas.

According to an advantageous embodiment a conduit for supplying protective gas is provided within the discharge channel, including downwardly directed bores above the furnace door and the casting spout.

Through these bores protective gas may be blown in if needed so that something like a gas veil or curtain is erected in front of the two large furnace openings. Such a gas veil prevents secondary air from penetrating into the furnace interior if there is a short depression in the furnace, and even enables the possible opening of the furnace door during melting without contaminating the melt—for instance by oxidation or nitrogen absorption. Further bores in the conduit for the same purpose as above are, of course, possible—for instance, also above the passage openings for the plasma burners. Depending on the composition of the melt, noble gases are preferably used as protective gases for the gas veil, in particular argon, nitrogen or carbon dioxide.

BRIEF DESCRIPTION OF THE DRAWINGS

The invention will now be explained in more detail with reference to the accompanying drawings, wherein.

DESCRIPTION OF EXEMPLARY EMBODIMENT

Figure 1:
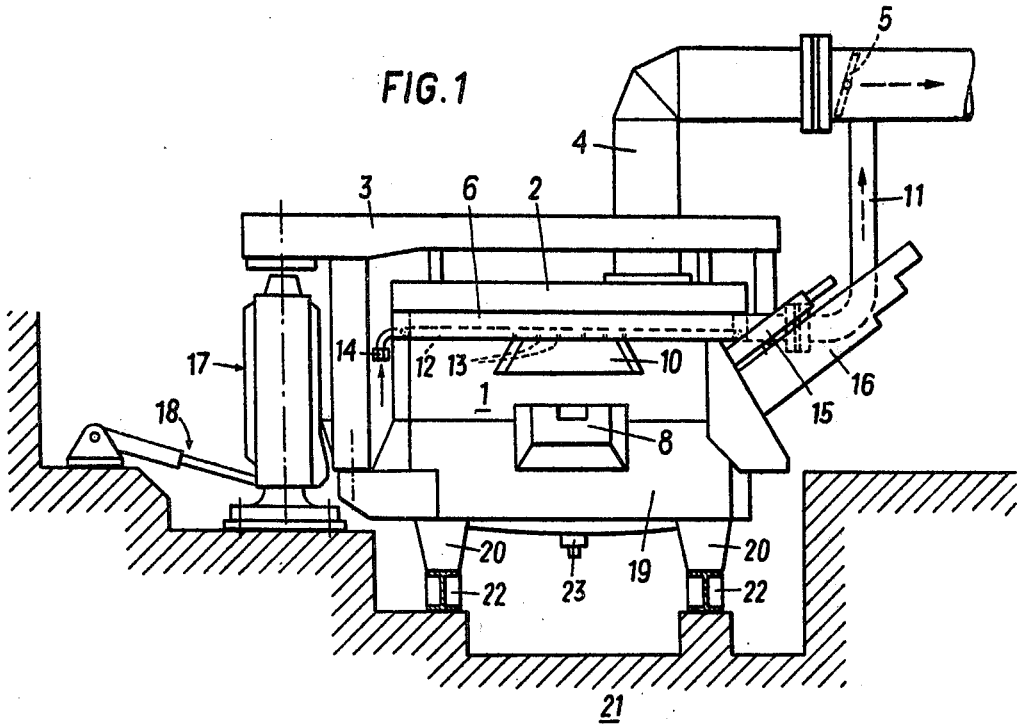
FIG. 1 is a side view of an embodiment of the plasma melting furnace according to the invention.
Figure 2:
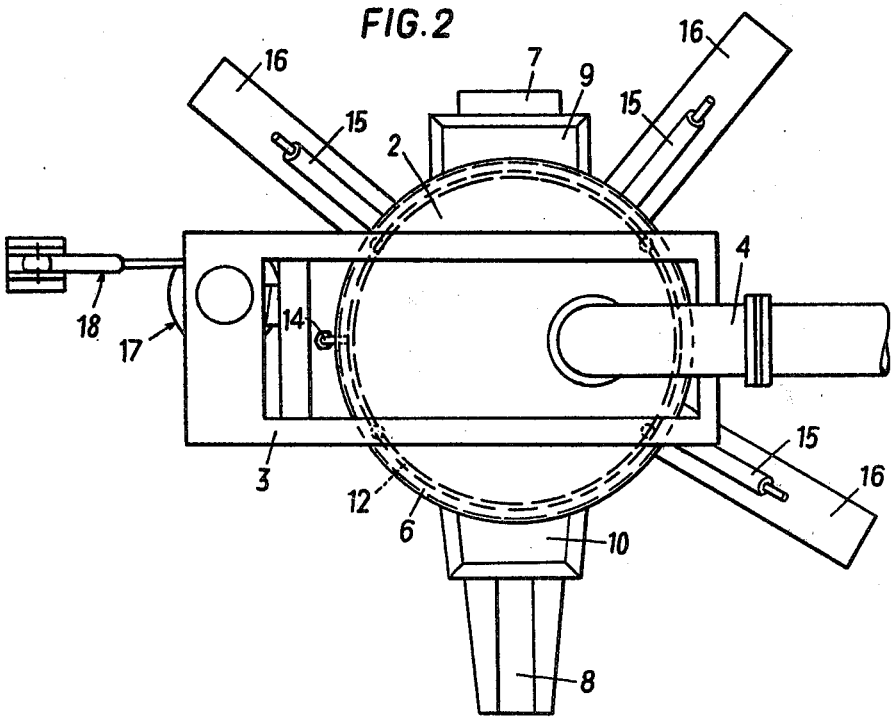
FIG. 2 is a top view of the same.

On a substantially cylindrical melt container 1 of a plasma melting furnace a water-cooled cover 2 rests. The cover is connected with a cover carrying means 3. From an evacuation opening in the cover a flue gas conduit 4 leads away via a tube bend. A throttle valve 5 is installed in the flue gas conduit as draft regulating damper. The flue gas conduit 4 is connected to an evacuation means (down-draft ventilator) (not illustrated).

Below the cover 2 a downwardly open channel 6 is attached to the outer side of the melt container 1 along the total circumference of the container 1.

Figure 3:
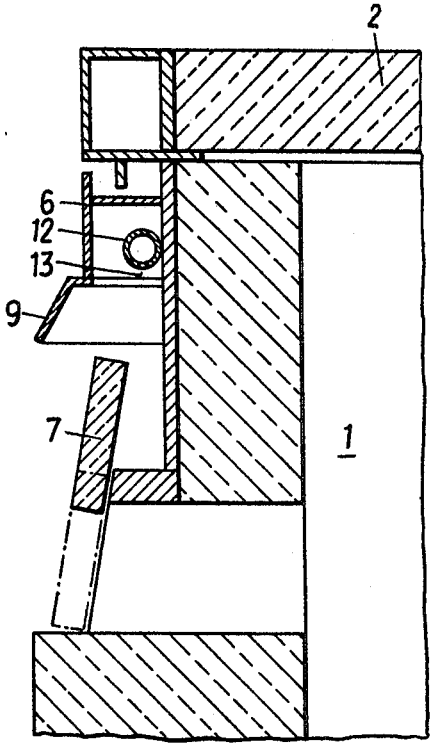
FIGS. 3 and 4 illustrate details in the region of the furnace door and in the region of the casting spout, enlarged and in section.
Figure 4:
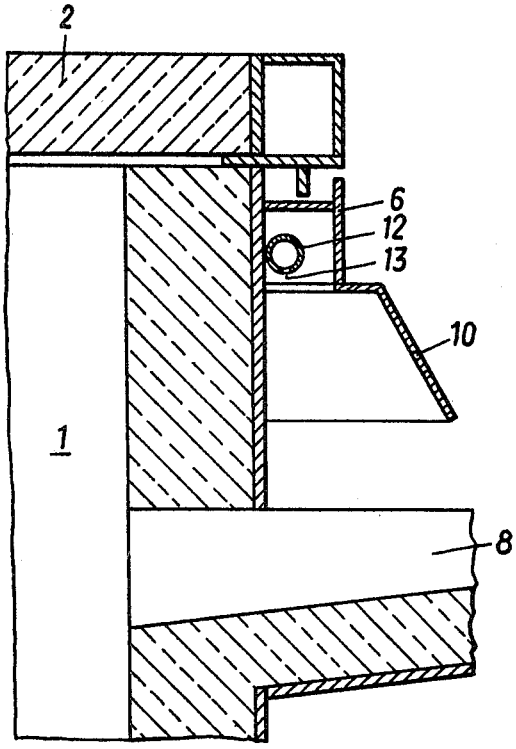
Figure 5:
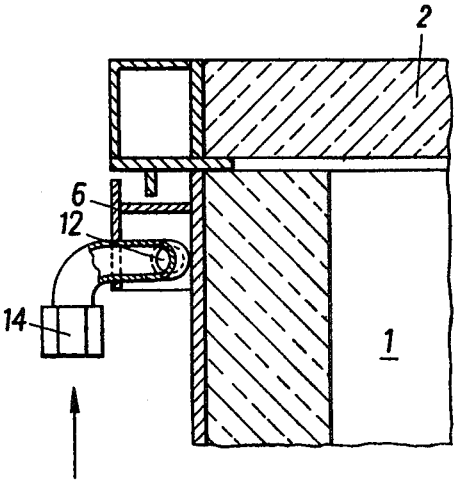
FIG. 5 illustrates a partially sectioned cutout from the discharge channel with the connection site for the supply conduit of protective gas.

Above the furnace door 7 and above the casting spout 8, the discharge channel 6 has hood-like enlargements 9, 10 (FIGS. 3 and 4); the channel 6 is connected with the flue gas conduit 4 via a connection conduit 11, which connection conduit 11 enters into the flue gas conduit 4 only after the throttle valve 5. Within the channel 6 an annular conduit 12 with downwardly directed bores 13 above the furnace door 7 and the casting spout 8 is provided, to which a protective gas may be admitted via a connection piece 14 (FIG. 5).

Three plasma burners 15 are guided through the side wall of the melt container so as to be inclined towards the furnace axis. The plasma burners are movably mounted on supports 16.

Laterally of the melt vessel 1, a cover lifting means 17 and a cover printing means 18 are arranged. The bottom part 19 of the furnace rests on runways 22 supported on the base 21 by movable beams 20. The bottom electrode 23 penetrates the bottom part 19 (the current connection is not shown).

During the melting procedure, the flue gas conduit 4 leading away from the cover 2 of the plasma melting furnace is closed by means of a throttle valve 5. Thereby the protective gas, which reaches the furnace interior through the plasma burners in a known manner, remains in the furnace; the air originally contained in the furnace interior and the smoke gases forming during melting escape through the furnace openings mentioned and are evacuated via the channel 6, the connection conduit 11 and the flue gas conduit 4 by means of a down-draft ventilator. The discharge of the gases is facilitated by the hood-shaped enlargements or projections 9 and 10 provided in the regions of the furnace door and the casting spout.

When using strongly contaminated material, it is, of course, also possible to pre-melt the material to be melted at the onset of the melting phase by means of an additional heating, a so called "auxiliary furnace", as well as by blowing in $O_2$, with large amounts of dust and fumes being formed, which can be rapidly evacuated by opening the throttle valve 5. The above-described melting procedure proper follows thereupon with the throttle valve 5 closed.

If iron or steel scrap is melted, the melt is usually refined.

The large amounts of reaction gases forming during the refining cycle are likewise drawn off through the flue gas conduit 4 via the furnace cover 2.

If no heavy smoke gas development occurs during melting, the down-draft ventilator need not be switched on at all. In this case, the danger exists that, on account of undefined flow conditions, pressure fluctuations occur and a slight depression temporarily comes about in the furnace interior, which would result in the penetration of secondary air into the furnace through the furnace door and/or the casting spout. The supply of secondary air is also possible as a result of permanently occurring counter diffusion processes.

Therefore, the annular gas conduit 12 is supplied with protective gas via its connection piece 14. The protective gas emerges through the bores 13, forming a protective gas veil in the regions of the furnace door 7 and the casting spout 8, as already described above.

What we claim is:

1. In a plasma melting furnace arrangement of the type including a cover, a melt container having a side wall and an upper rim, plasma burners arranged so as to be inclined towards the furnace axis and guided through said side wall, a main flue gas conduit connected to said cover and equipped with a draft regulating damper, and a separate discharge means provided for flue gases from other furnace openings, the improvement wherein said separate discharge means comprises a downwardly open channel attached to the outer periphery of said melt container adjacent said upper rim and wherein means are provided within said downwardly open channel for supplying a protective gas downwardly in an area above said furnace openings.

2. A plasma melting furnace as set forth in claim 1, further comprising a furnace door and a casting spout, and hood-like enlargements provided in said channel above said furnace door and said casting spout.

3. A plasma melting furnace as set forth in claim 1, further comprising a connection conduit arranged in the evacuation direction behind said draft regulating damper for connecting said channel with said main flue gas conduit leading away from said cover.

4. In a plasma melting furnace arrangement of the type including a cover, a melt container having an upper rim and a side wall with a furnace door and a casting spout therein, plasma burners arranged so as to be guided through said side wall and inclined toward an axis of said melt container, a main flue gas conduit connected to said cover and equipped with a draft regulating damper, and a separate discharge means provided for flue gases from other furnace openings, the improvement wherein said separate discharge means comprises a downwardly open channel attached to the outer periphery of said melt container in a region of said upper rim, a conduit for supplying protective gas being provided in said channel and having downwardly directed bores above said furnace door and said casting spout.

* * * * *

UNITED STATES PATENT AND TRADEMARK OFFICE

CERTIFICATE OF CORRECTION

PATENT NO. : 4,436,290

DATED : Mar. 13, 1984

INVENTOR(S) : Kilches et al.

It is certified that error appears in the above-identified patent and that said Letters Patent is hereby corrected as shown below:

First page, first col., following last line, insert:

--4,081,178 3/1978 Kopperstad et al. 266/158--.

First page, 2nd col., following first line, insert:

-- 945 287 7/1956 Fed. Rep. of Germany--.

First page, 2nd col., following fourth line, insert:

-- 2703859 8/1977 Fed. Rep. of Germany--.

Col. 1, line 9, after "axis" insert a comma.

Col. 2, line 25, "adjusted" should read --subjected--.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*